United States Patent [19]

Schweiss

[11] 4,063,876

[45] Dec. 20, 1977

[54] HEATER ATTACHMENT FOR L.P. GAS CONTAINER

[76] Inventor: Clifford E. Schweiss, Rte. 1, Box 81, Bloomsdale, Mo. 63627

[21] Appl. No.: 671,594

[22] Filed: Mar. 29, 1976

[51] Int. Cl.[2] ..... F24H 1/00; F23D 13/04

[52] U.S. Cl. ..... 432/222; 431/344

[58] Field of Search ..... 432/222; 431/171, 344, 431/347, 348

[56] References Cited

U.S. PATENT DOCUMENTS

| | | | |
|---|---|---|---|
| 1,822,356 | 9/1931 | McCartney et al. | 431/344 X |
| 2,181,138 | 11/1939 | Landis | 432/222 X |
| 2,569,084 | 9/1951 | White | 432/500 |
| 2,841,694 | 7/1958 | Webster | 431/344 X |
| 3,306,335 | 2/1967 | Myers | 432/222 |
| 3,329,416 | 7/1967 | Jackson | 432/500 |
| 3,429,306 | 2/1969 | Thompson | 431/347 X |
| 3,501,255 | 3/1970 | Greene | 431/344 X |

*Primary Examiner*—John J. Camby

*Attorney, Agent, or Firm*—Cohn, Powell & Hind

[57] ABSTRACT

This heater attachment includes an adaptor for attachment to the valve assembly of an L.P. gas bottle and providing a restricted gas outlet orifice; a burner receiving a gas jet from said orifice; a flame stack supported above the burner and a flame shield disposed above said stack and intercepting the path of the flame to deflect and contain the flame and facilitate heat distribution.

7 Claims, 5 Drawing Figures

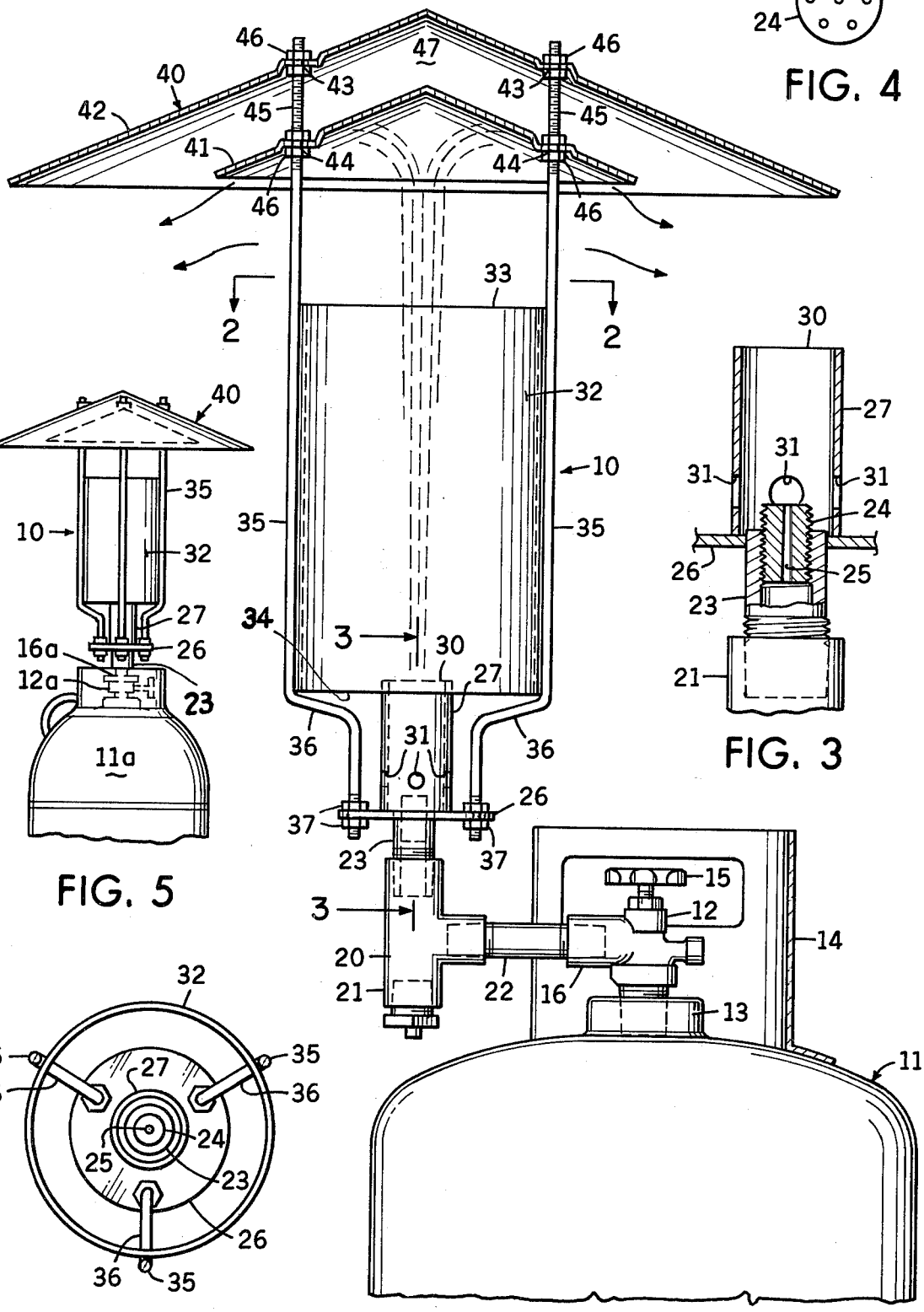
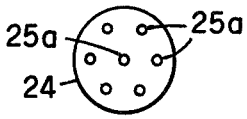
FIG. 4
FIG. 3
FIG. 5
FIG. 2
FIG. 1

HEATER ATTACHMENT FOR L.P. GAS CONTAINER

BACKGROUND OF THE INVENTION

This invention relates generally to an L.P. gas container heater assembly and particularly to a heater attachment for use with portable fuel containers, such as propane bottles.

Space heaters are commonly used in cold weather to heat buildings during construction. Such heaters permit craftsmen to complete the building interior and are particularly useful when the construction of the building shell is sufficiently advanced to provide adequate cover.

Conventional heaters generally burn fuel oil and suffer from the disadvantage of creating a smoke problem, which is particularly objectionable in confined working areas. Propane burners are known which operate in conjunction with regulators to reduce the pressure to the level necessary for this type of burner unit, but such units are of an essentially different character to the attachment herein.

SUMMARY OF THE INVENTION

This heater attachment is used in conjunction with an L.P. propane fuel container, such as a propane bottle, to provide a portable space heater.

It is an object of this invention to provide a heater attachment which includes an adaptor attachable to the container outlet and having an outlet orifice of considerably reduced size from said container outlet to provide highly efficient combustion without the need for a pressure regulator.

It is another object to provide an open ended burner chamber receiving gas from the restricted orifice.

Another object is to provide a flame shield which forms an integral part of the attachment and provides a means of deflecting and containing the flame and facilitating heat radiation.

It is yet another objective to provide a heater attachment can be utilized with various conventional container sizes, such as 20 pound, 30 pound and 100 pound L.P. gas bottles, and which can be used to extract the fuel from the bottle virtually to the empty point.

It is an important object to provide a heater attachment for a propane bottle which is simple and inexpensive to manufacture and easy to use and extremely efficient in operation.

BRIEF DESCRIPTION OF THE DRAWINGS

FIG. 1 is a longitudinal sectional elevation illustrating the heater attachment used in conjunction with a conventional fuel container having a side outlet;

FIG. 2 is a sectional plan view taken on line 2—2 of FIG. 1;

FIG. 3 is an enlarged fragmentary sectional view taken on line 3—3 of FIG. 1, illustrating the burner plug and burner assembly;

FIG. 4 is a plan view of the burner plug illustrated in FIG. 3 but having a modified outlet orifice arrangement; and FIG. 5 is an elevational view of the heater attachment used in conjunction with a fuel container having a longitudinal outlet.

DESCRIPTION OF THE PREFERRED EMBODIMENT

Referring now by characters of reference to the drawing and first to FIG. 1, it will be understood that the heater attachment generally indicated by numeral 10 is intended for use in conjunction with a propane or similar liquid fuel container such as that indicated by numeral 11. The container 11 is conventional in that it includes a throttle valve 12 threadedly attached to the bottle neck 13. A semicircular hood 14 provides a means of protecting the valve 12 and said valve includes a conventional rotatable handle 15 which controls the release of gas from the gas outlet 16.

The heater attachment 10 is connected to the gas outlet by means of an adaptor 20 which, in the embodiment shown, includes a T-shaped fitting 21 connected to the gas outlet 16 by means of a short branch pipe 22, said pipe providing an inlet orifice means communicating with said gas outlet. The gas outlet orifice means is best shown in FIG. 2 and includes a plug 23 threadedly attached into the upper end of the fitting 21. An inner plug 24 is threadedly received within the outer plug 23, said inner plug 24 having an outlet orifice cross sectional area considerably smaller than the cross sectional area of the container gas outlet 16. Single or multiple orifices may be provided, as shown in FIGS. 3 and 4 respectively by numerals 25 and **25*a***, as will be described providing a cross sectional area of from about 0.001 sq. ins. to 0.0025 sq. ins.

A base plate 26 is welded, or otherwise attached, to the outer plug 23 and provides a support for the intermediate and upper portions of the heater attachment 10. The intermediate portion of said attachment 10 includes a tubular burner member 27 welded, or otherwise attached, to the base plate 26 providing a mixing chamber and an open ended burner head constituting a burner means. The burner member 27 includes an open upper end 30 and is provided toward its lower end with a plurality of air inlet openings 31. A cylindrical flame stack 32 providing a flame chamber having open, opposed ends 33 and 34 is mounted above the burner member 27 in coaxial relation thereto and provides a protective cover for the longitudinally extending flame. In the preferred embodiment the burner member 27 extends into the relatively large diameter stack 32, which is supported by means of a plurality of upwardly extending rods 35. Support rods 35 are bent inwardly to provide seating portions 36, said rods being threaded at their lower end for attachment to the base plate 26 by means of nuts 37.

The support rods 35 also provide a support means for the upper portion of the heater attachment 10 which constitutes a heat shield and is generally indicated by numeral 40. As clearly shown in FIG. 1 the heat shield 40 intercepts the path of the flame issuing from the burner member 27 and includes an inner conical member 41 which is coaxially disposed in longitudinally spaced relation from an outer conical member 42. Each of said members 41 and 42 includes a plurality of apertures, indicated by numerals 43 and 44 respectively, said apertures being provided at equal intervals to receive the threaded upper ends 45 of rods 35. As clearly shown the conical members 41 and 42 are attached to said rods 35 as by nuts 46. It will be understood that the flame impinges directly on the relatively thick inner conical member 41 but not the relatively thin outer conical member 42 from which it is spaced by the rods 35. The space between the members 41 and 42 acts to insulate the outer member from direct flame impingement by providing a generally outwardly radiating passage indicated by numeral 47. In addition, the outer diameter of the conical member 42 is considerably greater than that of the inner conical member 41 and sufficiently so to substantially preclude the overlap of flame beyond the outer circumferential margin of said outer member 42.

FIG. 5 illustrates the use of the heater attachment 10 with a gas container 11*a* having a throttle valve 12*a* and a vertical outlet 16*a*. In this embodiment the plug 23 can be threaded directly into the outlet 16*a* if desired, or can be connected to said outlet 16*a* by means of a relatively short adaptor (not shown). In other respects the heater attachment shown in FIG. 5 is identical to that described above.

It is thought that the structural and functional advantages of this heater attachment have become apparent from the foregoing description of parts. However, for completeness of disclosure the assembly and operation of the device will be briefly described.

As noted above the heater attachment is intended for use with conventional propane or similar liquid fuel containers and can be adapted for use with a side valve or a vertical valve. The operation is essentially the same and will be described with reference to the side valve 12 shown in FIG. 1.

In the case of the container having side valve 12, the heater attachment is mounted in an offset position by means of an adaptor 20 which includes a Tee fitting 21, a branch pipe 22, and an adaptor plug 23 having an inner plug 24, which provides an outlet orifice means and a base plate 26.

This outlet orifice, which is considerably smaller in cross sectional area than the gas outlet 16 has an area in the range of from about 0.001 sq. ins. to 0.0025 sq. ins. which restricts flow from the gas outlet into the burner member. As shown in FIGS. 3 and 4 respectively, single or multiple orifices can be used. By way of example, a single tapered orifice, indicated by numeral 25 in FIG. 3 has given good results having a minimum cross sectional area of 0.0015 sq. ins. provided by #57 gauge bit. Alternatively, multiple orifices have also given good results, and in one embodiment shown in FIG. 4, seven such orifices are provided having a combined cross sectional area of 0.001 sq. ins., said orifices being formed by #80 gauge bit. This latter, multiple orifice arrangement, has the advantage of providing a burner which operates with particular quietness.

Essentially, the heater attachment 10, as a whole, is connected to the adaptor 20 by virtue of base plate 26 and is thereby readily attached to the Tee fitting 21 by simply threadedly connecting the plug 23 to said fitting. The stack 32 and flame shield 40 are assembled to the base plate 26 by means of the threaded rods 35, and the self seating nature of the assembly is such that it is not necessary to weld or fixedly attach the stack to said rods 35.

When it is desired to use the heater attachment following assembly it is simply a matter of rotating the throttle valve handle 15 and igniting the gas and air mixture formed from the gas jet issuing from the restricted orifice 25 and the air entering the burner tube peripheral holes 31, as by inserting a match through one of said holes. The resulting upwardly directed flame is controlled by the throttle 15 to the extent desired to impinge to a greater or lesser extent upon the inner conical member 41. In the prefered embodiment, this inner member 41 is of 18 gauge sheet steel as opposed to the outer member 42, which is of 24 gauge sheet steel. The inner member 41 can be heated to a high temperature and yet is not directly exposed because of the cover provided by the outer member 42, which is insulated from direct contact with said inner member 41 by the air space provided by the passage 47. Moreover, the inner member can be more evenly heated because flames can extend outwardly to the periphery of the inner member yet still be within the confines of the device as a whole as defined by the periphery of the outer member 42. The heating efficiency of the attachment 10 is further enhanced by the fact that heated air rising in the flame stack 32 is deflected outwardly by said inner conical member 41 rather than upwardly. It will be understood that direct radiation from the outer member 42 also occurs but is less than it would be if such member were directly in the path of the flame.

I claim as my invention:

1. A heater attachment for an L.P. gas container having a gas outlet, the attachment comprising:

a. adaptor means attachable to the gas outlet, and including a restricted outlet orifice means, b. burner means carried by the adaptor means and including a mixing chamber communicating with the outlet orifice and receiving gas therefrom, c. a flame chamber disposed superjacently of the burner mixing chamber and receiving flame therefrom and including an open outer end, and d. flame shield means disposed above the flame chamber in the path of the flame, said flame shield being outwardly spaced from said open outer end in overlapping relation thereto.

2. A heater attachment as defined in claim 1, in which:

e. the restricted orifice is substantially in the area range of 0.001–0.0025 sq. ins. to permit use without pressure regulation.

3. A heater attachment as defined in claim 1, in which:

e. the mixing chamber includes a tubular member having a plurality of circumferential air openings disposed outside of the flame chamber, and an open upper end, f. the flame chamber is substantially cylindrical and is open at both ends and coaxially disposed relative to the mixing chamber, and g. the flame chamber is separated from said mixing chamber and is operatively carried by the adaptor means.

4. A heater attachment as defined in claim 1, in which:

e. the flame shield means includes generally cup-shaped concentric inner and outer members both spaced from the flame chamber and defining a substantially unobstructed circumferentially open insulating passage.

5. A heater attachment as defined in claim 1, in which:

e. the flame shield means includes concentric inner and outer conical members both spaced from the flame chamber said inner conical member receiving the flame directly and said outer member, having a larger diameter, providing a cover.

6. A heater attachment for an L.P. gas container having a gas outlet, the attachment comprising:

a. an adaptor means threadedly attachable to the gas outlet and having an inlet orifice receiving gas from said outlet and a restricted outlet orifice means, b. base means operatively attached to the adaptor means, c. burner means including a tubular mixing chamber mounted to the base means and disposed in coaxial relation to the restricted outlet orifice, said chamber having a plurality of lower air inlet openings and an open upper end, d. a flame chamber having an open upper end and an open lower end disposed in coaxial relation to said mixing chamber and separated therefrom by an annular air opening, e. flame shield means disposed in spaced relation above said flame chamber in overlapping relation thereto and including an inner conical member intercepting the path of the flame an an outer conical member having a larger diameter than said inner conical member and spaced from said inner conical member to define an insulating passage thereby, and f. support means operatively attached to said base means and carrying said flame chamber above the base means, said support means holding said flame shield means in spaced relation from said flame chamber and holding said conical members in spaced relation from each other to define said passage.

7. A heater attachment as defined in claim 6, in which:

g. the restricted outlet orifice means includes a plurality of orifices having a combined, cross sectional area in the range of 0.001–0.0025 sq. ins. substantially less than the gas outlet to provide a quiet operation.

* * * * *